US006217278B1

(12) United States Patent
Shiokawa et al.

(10) Patent No.: US 6,217,278 B1
(45) Date of Patent: Apr. 17, 2001

(54) TURBOMOLECULAR PUMP

(75) Inventors: Atsushi Shiokawa, Tokyo; Matsutaro Miyamoto; Hirosi Sobukawa, both of Kanagawa-ken, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/120,469

(22) Filed: Jul. 23, 1998

(30) Foreign Application Priority Data

Jul. 25, 1997 (JP) ..... 9-215645

(51) Int. Cl.[7] ..... F03B 5/00

(52) U.S. Cl. ..... 415/90; 415/151; 415/157

(58) Field of Search ..... 415/90, 151, 156, 415/157; 417/505, 423.4, 295

*Primary Examiner*—F. Daniel Lopez
*Assistant Examiner*—Ninh Nguyen
(74) *Attorney, Agent, or Firm*—Armstrong, Westerman, Hattori, McLeland & Naughton LLP

(57) ABSTRACT

A turbomolecular pump comprising a rotor and a stator housed in a casing and an exhaust mechanism is formed between the rotor and the stator; wherein the turbomolecular pump has a valve body for opening and closing a suction port provided in the casing, and a valve driving mechanism for opening/closing-driving the valve body, wherein the valve driving mechanism is provided integrally with the turbomolecular pump.

12 Claims, 4 Drawing Sheets

TURBOMOLECULAR PUMP

BACKGROUND OF THE INVENTION

The present invention relates to a turbomolecular pump for exhausting a gas by an interaction between a rotor and a stator and/or by an action of threaded rotor rotating at a high speed.

A general construction of a conventional turbomolecular pump is illustrated in FIG. 4. The turbomolecular pump comprises a rotor R including a main shaft 10 and a rotary cylinder 12 rotating integrally therewith, a stator S including a fixed cylinder 14 surrounding the shaft 10, and a cylindrical casing 16 surrounding the rotary cylinder 12, which are assembled on a base B. A conductance adjusting valve 100 and a gate valve 110 are provided between the pump and an apparatus A to be evacuated in the upstream of the turbomolecular pump.

In the conventional turbomolecular pump as described above, however, driving mechanisms 101, 102 for the individual valve units are provided in the proximity of the valves near the turbomolecular pump. This has posed a problem of scaling-up of the valve units, resulting in a larger overall structure of the turbomolecular pump including the valves.

SUMMARY OF THE INVENTION

In view of the problem described above, the present invention was made and has an object to provide a turbomolecular pump which enables a compact construction of the overall apparatus to be realized including the valve units.

To achieve the above object, according to a first aspect of the invention a turbomolecular pump is provided which comprises a rotor and a stator housed in a casing and an exhaust mechanism is formed between the rotor and the stator; wherein the turbomolecular pump has a valve body for opening and closing a suction port provided in the casing, and a valve driving mechanism for opening/closing driving the valve body, wherein the valve driving mechanism is provided integrally with the turbomolecular pump. This makes it possible to achieve a compact overall construction including the valve units.

According to a second aspect of the invention, in a turbomolecular pump according to the first aspect, the valve driving mechanism is so constructed that it drives the valve body in the axial direction of the rotor. By this arrangement, it is possible to achieve a simple construction of the entire valve unit which does not require a large space for installation thereof, since the valve body is opened or closed by lifting or lowering the valve body relative to the suction port.

According to a third aspect of the invention, in a turbomolecular pump according to the first aspect, the valve driving mechanism is provided outside the stator.

According to a fourth aspect of the invention, in a turbomolecular pump according to the first aspect, the valve driving mechanism is provided at the center portion of the suction port.

According to a fifth aspect of the invention, in a turbomolecular pump according to any one of the above aspects, the valve driving mechanism is provided so as to make the degree of opening of the valve body adjustable. This permits simultaneous functioning of valve units as a gate valve and a conductance adjusting valve, thus allowing further simplification and space saving.

According to the present invention, as described above, since the valve driving mechanism is provided integrally with the turbomolecular pump, it is possible to connect the suction port of the turbomolecular pump directly to a duct or the like of an apparatus to be evacuated. In addition, because the valve driving unit can drive a valve supporting member which supports the valve body in the axial direction of the rotor, the structure of the valve unit and the valve driving mechanism can be made far simpler. It is therefore possible to provide a turbomolecular pump having a compact overall construction, including the valve units.

The above and other objects, features and advantages of the present invention will become more apparent from the following description when taken in conjunction with the accompanying drawings in which preferred embodiments of the present invention are shown by way of illustrative examples.

DESCRIPTION OF THE PREFERRED EMBODIMENTS

Figure 1:
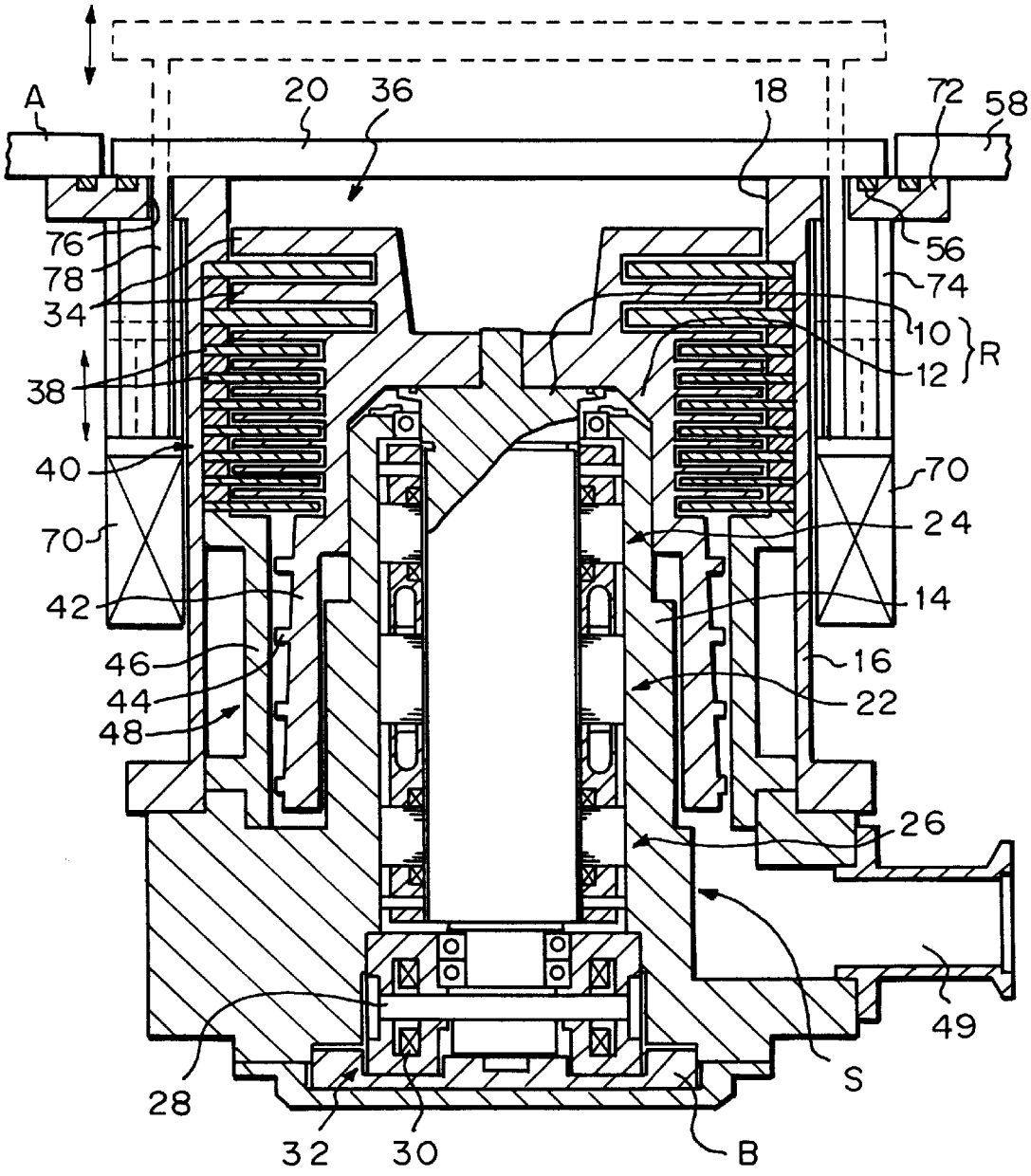
FIG. 1 is a sectional view illustrating a turbomolecular pump of a first embodiment of the invention.

Preferred embodiments of the present invention will now be described with reference to the drawings. The turbomolecular pump of a first embodiment of the invention shown in FIG. 1 comprises a rotor R including a main shaft 10 and a rotary cylinder 12 fixed thereto for rotating integrally with the main shaft, a stator S including a fixed cylinder 14 surrounding the main shaft 10, and a cylindrical casing 16 surrounding the rotary cylinder 12 and fixed to the stator S which, in turn, is fixed to a base B. A disk-shaped valve body 20 is provided on a suction port 18 of the casing 16 for opening and closing the suction port 18.

A driving motor 22 is provided between the main shaft 10 and the fixed cylinder 14 for rotaing the shaft. An upper radial bearing 24 and a lower radial bearing 26 are provided on an upper and lower side of the driving motor 22, respectively, for rotatably supporting the shaft. In the lower portion of the main shaft 10, a target disk 28 is fixed at the lower end of the main shaft, and an axial bearing 32 is formed by the target disk 28 and upper and lower coils 30 fixed to the stator S. By this arrangement the rotor R can rotate at a high speed under active control along the axis by the action of the driving motor 22.

Rotary blades 34 are formed integrally with the rotary cylinder 12 on the outer periphery of the upper portion thereof so as to form impellers 36. On the inner surface of the casing 16, on the other hand, fixed blades 38 are provided alternately with the rotary blades 34, with a spacer interposed therebetween. There is therefore formed a blade exhaust section 40 between the rotary blades 34 and the fixed blades 38 and gas exhaust action is accomplished through interaction of the rotary blades 34 rotating at high speed and the stationary blades 38.

A cylindrical screw thread portion 42 extending downward along the outer periphery of the fixed cylinder 14 is integrally formed with the rotary cylinder 12, and a screw thread 44 is formed on the outer peripheral surface of the screw thread portion 42. A thread spacer 46 surrounding the outer periphery of the screw thread portion 42 is provided on the stator S. As a result, a screw-thread exhaust section 48 which performs gas exhaust action under drag action created by the screw thread 44 of the screw thread portion 42 rotating at a high speed is formed between the blade exhaust section 40 and an exhaust port 49.

Valve driving units 70 for driving the valve body 20 in the axial direction of the rotor R are attached to fixing members 74, which extend from a flange 72 of the cylindrical casing 16 and are arranged circumferentially at equal intervals. Throughholes 76 are formed circumferentially spaced around the flange 72. A plurality of valve rods 78 connecting the peripheral portion of the valve body 20 and the valve driving units 70 are inserted into the throughhole 76. An O-ring 56 is provided on the flange surface to maintain air-tightness when the valve body 20 is closed against the suction port 18. Actuators for the valve driving units 70 may comprise a piston cylinder unit operated by hydraulic pressure or pneumatic pressure or a ball screw unit driven by a motor.

Figure 4:
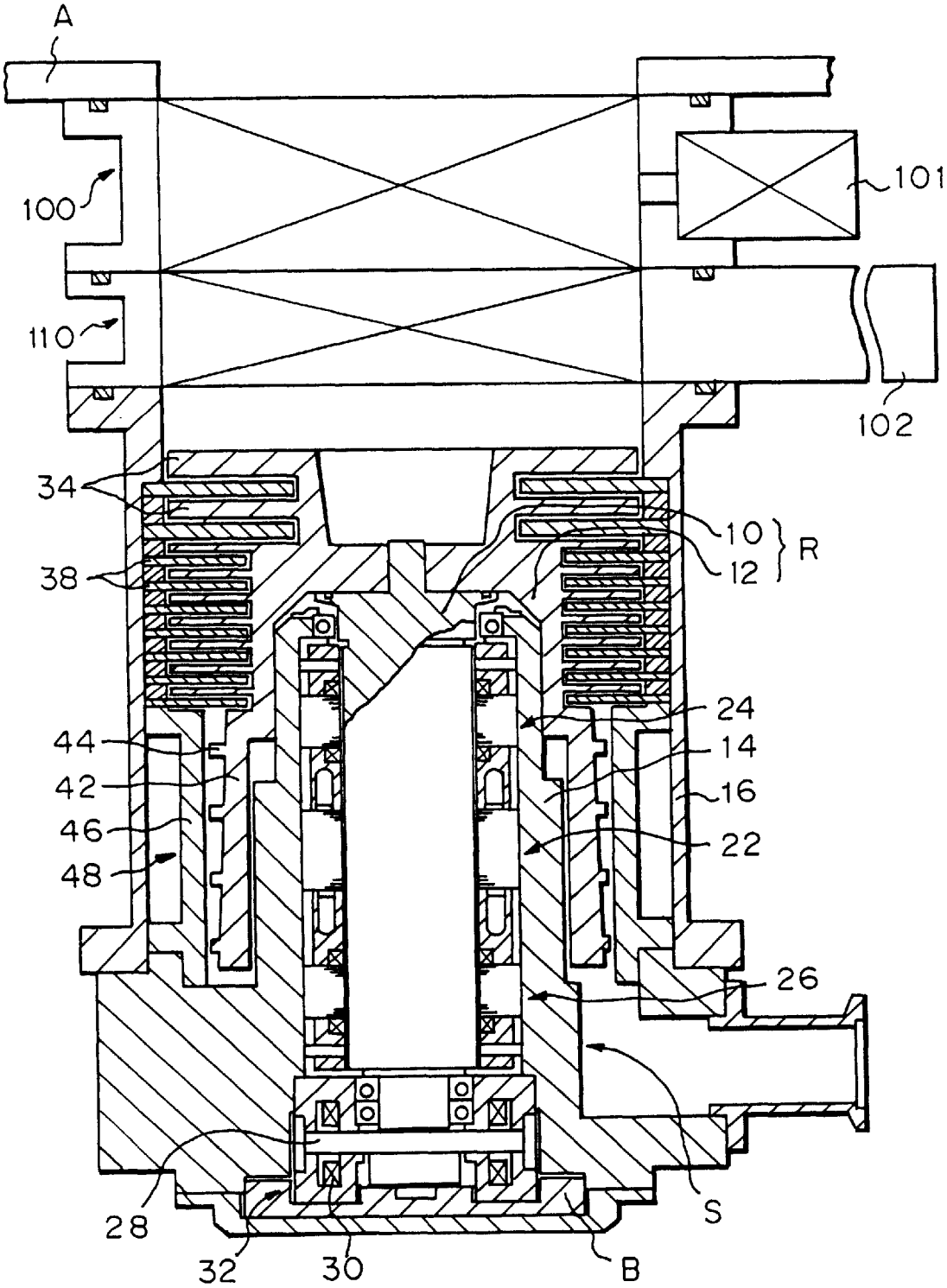
Fig. 4 PRIOR ART
FIG. 4 is a sectional view illustrating a conventional turbomolecular pump.

According to the construction and arrangement as described above, the valve body 20 can be operated to open or close the suction port 18 under operation of the actuator of the driving unit 70, and conductance can be adjusted by controlling the valve opening of the valve body 20. As illustrated, the turbomolecular pump can be directly attached to a duct 58 or the like of the apparatus A to be evacuated without interposing valve unit therebetween as shown in FIG. 4. Since the actuator of the valve driving units 70 drives the valve body 20 in the axial direction of the rotor R, the construction of the valve units and the driving mechanism can be made far simpler. It is therefore possible to provide a more compact turbomolecular pump as a whole, and use it effectively in a narrow space such as a clean room.

Figure 2:
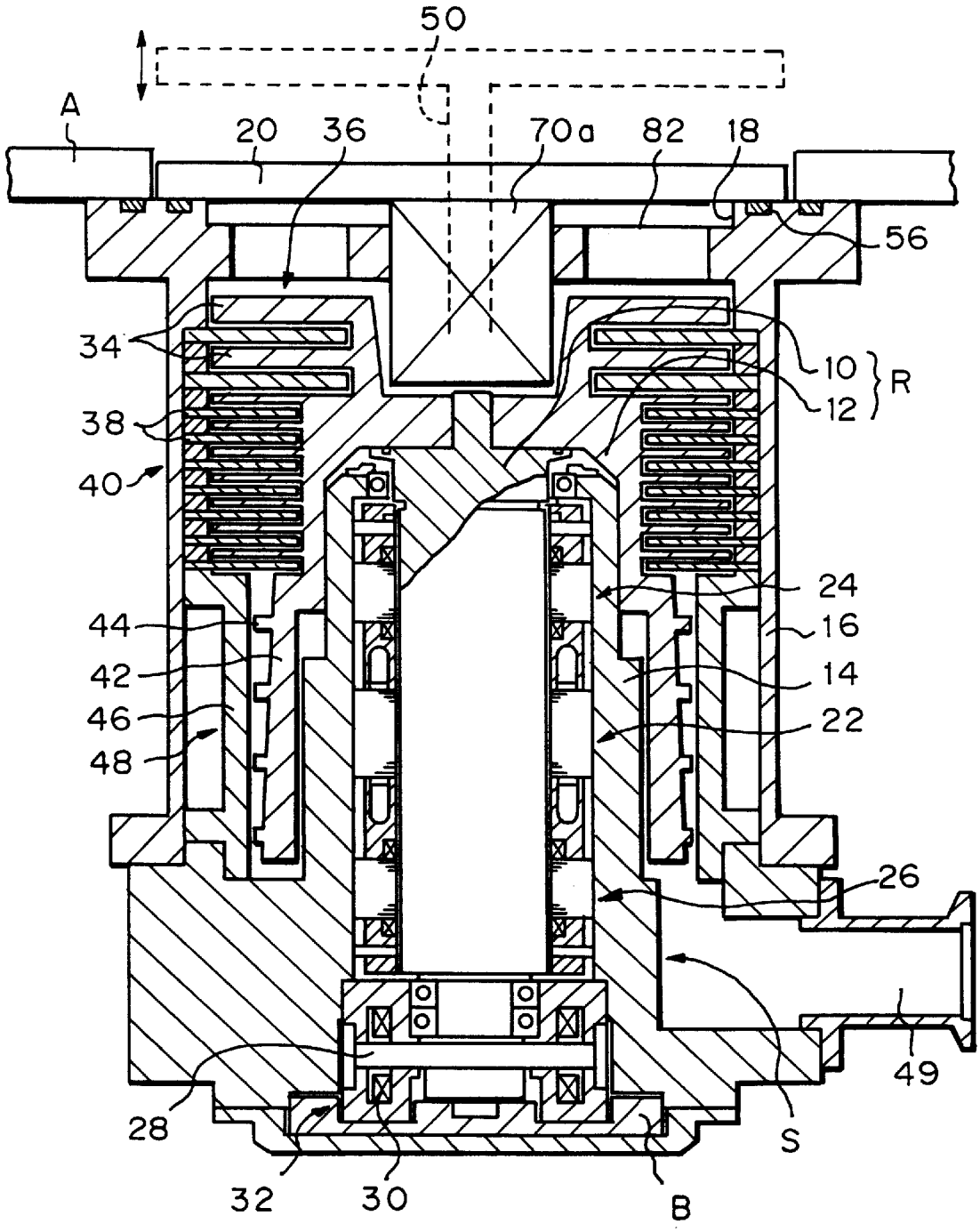
FIG. 2 is a sectional view illustrating a turbomolecular pump of a second embodiment of the invention.

FIG. 2 illustrates a second embodiment of the invention wherein only one valve rod 50 is provided at the center thereof, and a valve driving unit 70*a* is supported at the center portion of a suction port 18 by an arm or arms 82 extending from the casing 16. In an ordinary turbomolecular pump, the center portion of the suction port is provided with a space into which the rotor R does not extend. In this embodiment, this space is used to house the valve driving unit 70*a*. In this case, however, since the valve driving unit 70*a* is installed within a vacuum evacuating system, the valve driving unit 70*a* is required to have as small sliding portion as possible to avoid contamination. Thus, an electromagnetic driving means could be preferably used.

Figure 3:
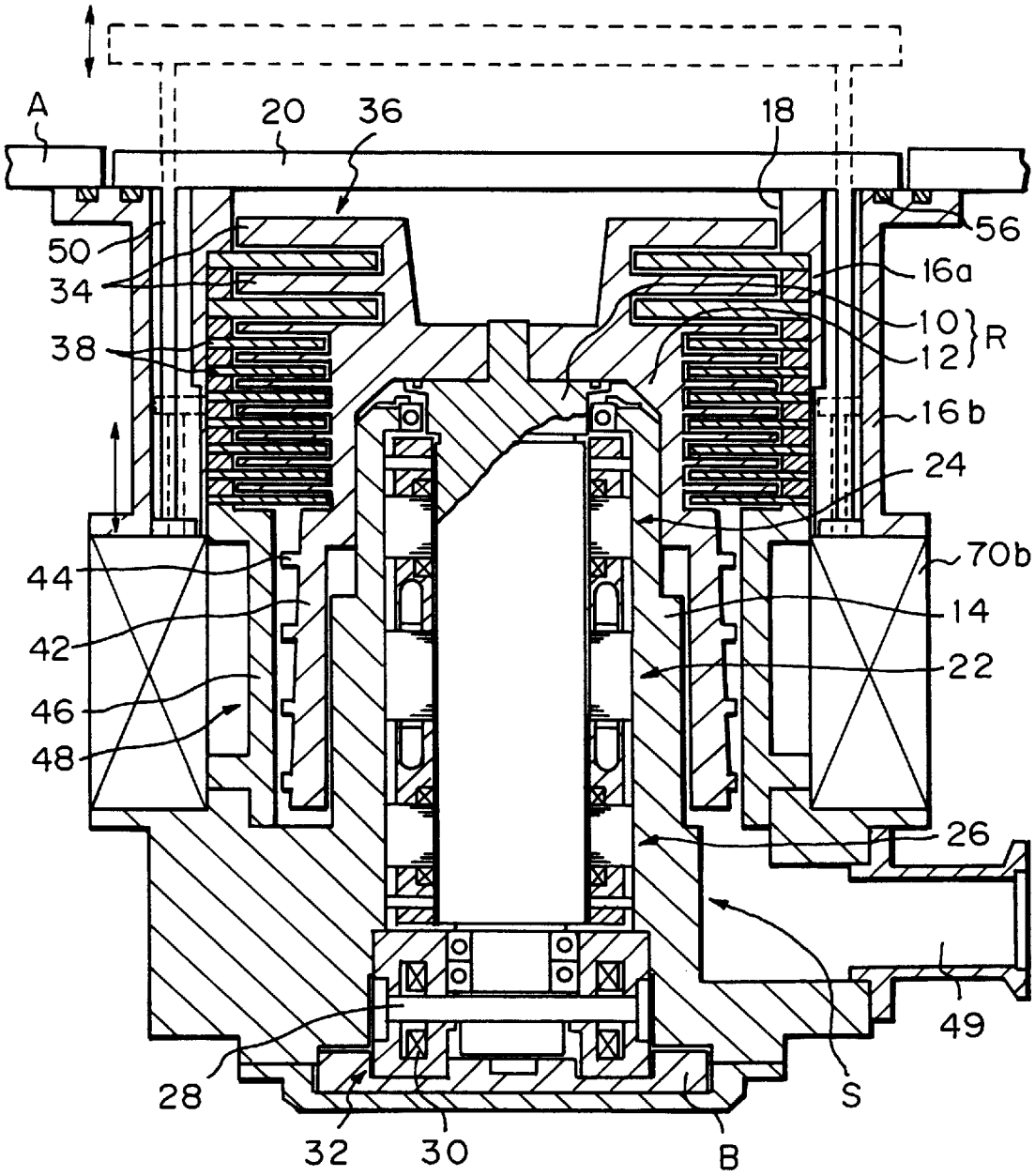
FIG. 3 is a sectional view illustrating a turbomolecular pump of a third embodiment of the invention.

FIG. 3 illustrates a third embodiment of the invention. In this embodiment, an actuator for a valve driving unit 70*b* is formed into a cylindrical shape forming a part of a casing, and a plurality of valve rods 50 are attached thereto. The valve rods 50 are housed in a space between an inner casing 16*a* and an outer casing 16*b*. In this embodiment, since the actuator of the valve driving unit 70*b* has a large capacity, it is possible to perform stable and positive opening/closing operations.

As described above, according to the present invention, since the valve driving mechanism is provided integrally with the turbomolecular pump, it is possible to connect the suction port of the turbomolecular pump directly to a duct or the like of an apparatus to be evacuated. In addition, since the valve driving unit drives the valve supporting member supporting the valve body in the axial direction of the rotor, the structure of the valve unit and the valve driving mechanism can be made far simple. It is therefore possible to provide a turbomolecular pump having a compact overall construction including the valve units.

What is claimed is:

1. A turbomolecular pump comprising:

a casing for supporting a stator;

a rotor rotatably mounted in the stator and drivable by a motor;

the stator surrounding the rotor;

an exhaust mechanism formed between the rotor and the stator;

the suction port, associated with the exhaust mechanism, located in the casing;

a valve body provided on the suction port for opening and closing the suction port; and a valve driving mechanism, for driving the valve body, associated with the casing and positioned thereon at a location below a top of the suction port to provide a compact turbomolecular pump.

2. A turbomolecular pump according to claim 1, wherein said valve driving mechanism drives said valve body in the axial direction of said rotor.

3. A turbomolecular pump according to claim 1, wherein said valve driving mechanism is provided outside said stator.

4. A turbomolecular pump according to claim 1, wherein said valve driving mechanism comprises a plurality of valve driving units which are circumferentially spaced around the outer surface of said casing.

5. A turbomolecular pump according to claim 4, wherein said valve driving units are connected to said valve body through a plurality of valve rods extending through throughholes formed in a flange provided on said casing at the suction port thereof.

6. A turbomolecular pump according to claim 1, wherein said valve driving mechanism is formed to have a cylindrical shape forming a part of said casing with a plurality of valve rods being attached thereto.

7. A turbomolecular pump according to claim 6, wherein said casing includes an inner casing and an outer casing and said valve rods are housed in a space between said inner and outer casings.

8. A turbomolecular pump according to any one of claims 1 or 2–7, wherein said valve driving mechanism is provided so as to make the degree of opening of said valve body adjustable.

9. A turbomolecular pump according to any one of claims 1 to 7, wherein said valve driving mechanism comprises a piston cylinder unit operated by hydraulic pressure or pneumatic pressure, a ball screw unit driven by a motor or a electromagnetic driving means.

10. A molecular pump comprising:

a casing for supporting a stator;

a rotor rotatably mounted in the stator and drivable by a motor;

the stator surrounding the rotor;

an exhaust mechanism formed between the rotor and the stator;

the suction port, associated with the exhaust mechanism, located at the top of the casing;

a valve body provided on the suction port for opening and closing the suction port; said valve body having a diameter larger than said suction port; and a valve driving mechanism for driving the valve body up and down in the axial direction of said rotor;

wherein an opening is formed between said valve body and a flange provided at said suction port when said valve body is moved upwardly.

11. A turbomolecular pump according to claim 10, wherein said valve driving mechanism is provided at the center portion of said suction port.

12. A turbomolecular pump according to claim 11, wherein said valve driving mechanism is supported by an arm or arms extending from said casing.

* * * * *